US009914039B2

(12) United States Patent
Lee

(10) Patent No.: US 9,914,039 B2
(45) Date of Patent: Mar. 13, 2018

(54) GOLF PUTTING APPARATUS

(71) Applicant: Jung Hoon Lee, San Jose, CA (US)

(72) Inventor: Jung Hoon Lee, San Jose, CA (US)

( * ) Notice: Subject to any disclaimer, the term of this patent is extended or adjusted under 35 U.S.C. 154(b) by 0 days.

(21) Appl. No.: 15/132,047

(22) Filed: Apr. 18, 2016

(65) Prior Publication Data

US 2017/0296899 A1 Oct. 19, 2017

(51) Int. Cl.

*A63B 69/36* (2006.01)
*A63B 53/04* (2015.01)
*A63B 53/00* (2015.01)

(52) U.S. Cl.

CPC ..... *A63B 69/3685* (2013.01); *A63B 53/007* (2013.01)

(58) Field of Classification Search

USPC ..... 473/219, 249, 290, 324, 325, 334, 335, 473/341, 342, 287, 288, 340

See application file for complete search history.

(56) References Cited

U.S. PATENT DOCUMENTS 3,126,206 A * 3/1964 Sabia ..... A63B 69/3632 473/147
3,841,640 A * 10/1974 Gaulocher ..... A63B 69/3685 473/249
4,573,685 A * 3/1986 Young, IV ..... A63B 53/04 273/DIG. 14
D313,451 S * 1/1991 Shearer ..... D21/743
4,999,000 A * 3/1991 Finney ..... A63B 53/0487 473/341
5,078,398 A * 1/1992 Reed ..... A63B 53/0487 273/DIG. 14
5,308,067 A * 5/1994 Cook ..... A63B 53/0487 473/341
6,743,112 B2 * 6/2004 Nelson ..... A63B 53/0487 473/251
6,878,071 B1 * 4/2005 Schwieger ..... A63B 47/02 294/19.2
7,083,525 B2 * 8/2006 Pond ..... A63B 53/04 273/DIG. 14
2003/0162599 A1 * 8/2003 Klein ..... A63B 53/007 473/251

* cited by examiner

*Primary Examiner* — Nini Legesse
(74) *Attorney, Agent, or Firm* — Innovation Counsel LLP

(57) ABSTRACT

A golf putting apparatus is presented. The apparatus includes a putter with a shaft and a club head, wherein the club head has a center section carved out to form an opening. The bottom of the opening may be defined by a connector. When used with the opening uncovered, this putter provides the golfer with immediate feedback on his/her swing, such as whether the ball would have contacted the sweet spot of the club had the opening been closed, how hard the ball was hit, and which part of the ball was hit. A club face may be attached across the opening to "close" the opening so the putter may be used in a game.

16 Claims, 11 Drawing Sheets

GOLF PUTTING APPARATUS

TECHNICAL FIELD

The disclosure relates to a golf putting apparatus. In particular, it discloses a putter that may be used in two different modes.

BACKGROUND

Golf is a widely popular sport today enjoyed by men and women of all ages. Especially for individuals in urban areas who spend a lot of time in confined spaces and/or have busy schedules, being out in a golf course is appealing for many reasons. While driving a ball far in the desired direction often gets a player off to a good start for a hole, one cannot underestimate the importance of short game to complete a hole successfully. Hence, there are many putting apparatuses in the market today to help golfers practice putting.

To put accurately, a golfer has to have a high level of control in both the direction of the hit and the amount of strength applied. A slight deviation or miscalculation could end up in a higher score. Hence, a tool that trains a golfer to hit the ball with the sweet spot and teaches the golfer how to modulate his/her strength is desirable. It would be especially desirable to provide instant feedback to the golfer about whether the ball was hit with the club's sweet spot, and whether the right amount of power was applied.

Accordingly, there is demand for a golf putting practice device that trains the golfer to put accurately and allows the golfer to easily transfer what is learned to a real game.

SUMMARY OF THE DISCLOSURE

In one aspect, the inventive concept pertains to a golf putting apparatus including a shaft and a club head, wherein the club head has a center section carved out to form an opening having a bottom that is defined by a connector.

Optionally, a club face may be attached to the club head to close the opening.

DETAILED DESCRIPTION

A putter that is helpful for enhancing the player's putting abilities is presented. In particular, the putter disclosed herein may be used in a first mode (e.g., the "open" state) for practice and a second mode (e.g., the "closed" state) for playing. While the disclosure focuses on a few embodiments of the inventive concept for clarity and simplicity of illustration, it should be understood that the embodiments shown here are not exhaustive and there are many other ways in which the inventive concept may be practiced.

Figure 1A:
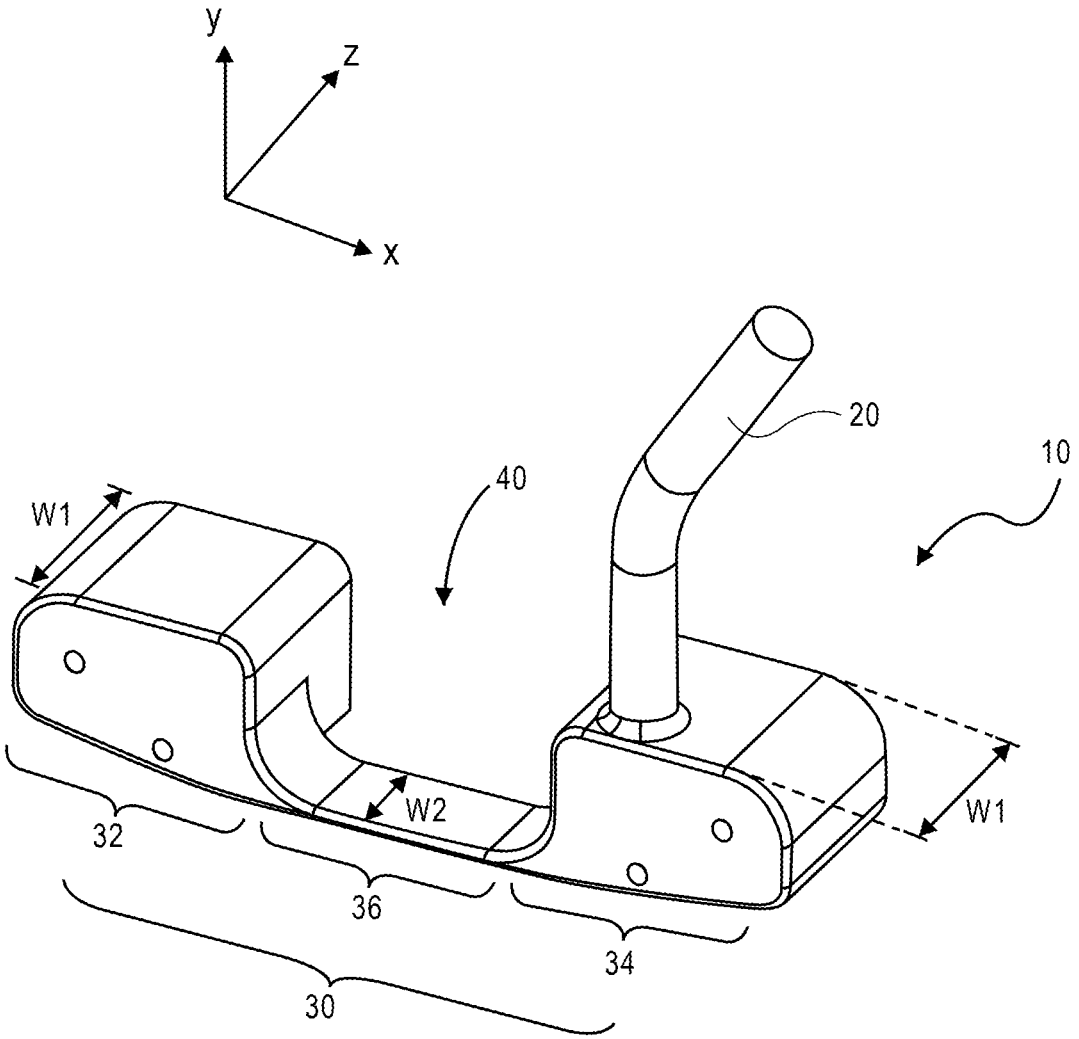
FIG. 1A, FIG. 1B, and FIG. 1C are perspective views of the putter in accordance with one embodiment of the inventive concept.
Figure 1B:
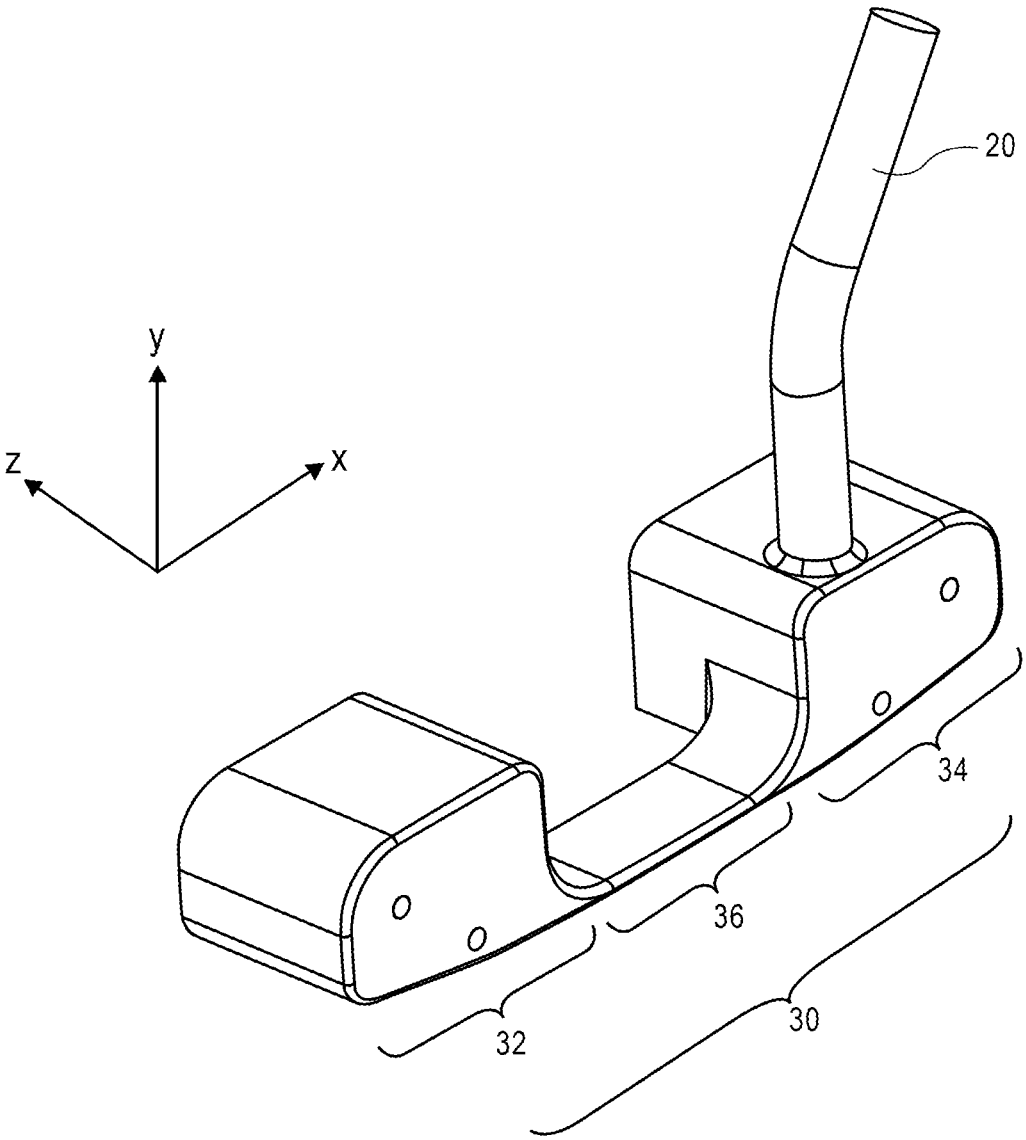

FIG. 1A and FIG. 1B depict an x-y-z coordinate system. As used herein, "length" refers to a measurement along the x-direction, "thickness" refers to a measurement along the y-direction, and "width" refers to a measurement along the z-direction.

FIG. 1A and FIG. 1B depict a putter 10 in accordance with one embodiment of the inventive concept. As shown, the putter 10 has a shaft 20 connected to a club head 30. The head 30 has an opening 40 in a center section of the head 30 such that the head 30 has a toe section 32 and a heel section 34 connected by a connector 36 in the x-direction. The opening 40, at least in part, is a through-hole that extends from the front surface to the back surface of the club head 30. The opening 40 is formed where the club head's sweet spot would be, and extends across the entire width of the head 30. The shaft 20 is connected to the heel section 34. In one embodiment, the toe section 32 and the heel section 34 have about the same first width w1. However, this is not a limitation of the inventive concept and the toe section 32 and heel section 34 may have different widths in some embodiments. The head 30 has a "front" surface that faces the ball, and a "back" surface that faces away from the ball when the ball is addressed. Referring to the x-y-z coordinate, the back surface is positioned further into the z-direction than the front surface.

The connector 36 has a second width w2 that is less than a first width w1. For example, the second width w2 may be about half of the first width w1. In the particular embodiment that is shown, the connector 36 is positioned so that it has an edge that is flush with the front surface of the toe section 32 and the heel section 34. Furthermore, in the particular embodiment, the connector 36 defines the bottom of the opening 40 and forms a base of the club 30 such that it comes in contact with the ground during use. However, these are not limitations of the inventive concept. In other embodiments, for example, the second width w2 could be the same as the first width w1 or the connector 36 could be positioned differently (e.g., centered along the width w1).

The connector may be made as thin as possible. For example, the connector 36 may be less than 0.1 inches thick. The connector 36 may have a relatively flat surface. However, in some embodiments, the connector 36 may be sloped such that the edge that is closest to the front surface is the thinnest portion of the connector 36, and the thickness increases in the z-direction. The slope may be implemented for a number of reasons, such as manufacturing convenience. For example, to make the front edge of the connector 36 thin without compromising the stability of the club head 30, a slope may be used on the connector 36. A user may practice putting by hitting a golf ball with the putter 10 in its "open" state. If the putter 10 hits the ball such that the ball would have been hit with the center portion (e.g., the sweet spot) of the head 30 if it had not been carved out, the ball will travel a certain way, as will be explained below. If, on the other hand, the putter 10 contacts the ball with either the toe section 32 or the heel section 34, the ball will roll forward in a direction different from the intended direction, at an angle to the z-axis. Hence, the user will get immediate feedback as to whether s/he successfully contacted the ball with a center portion of the putter head 30.

Figure 1C:
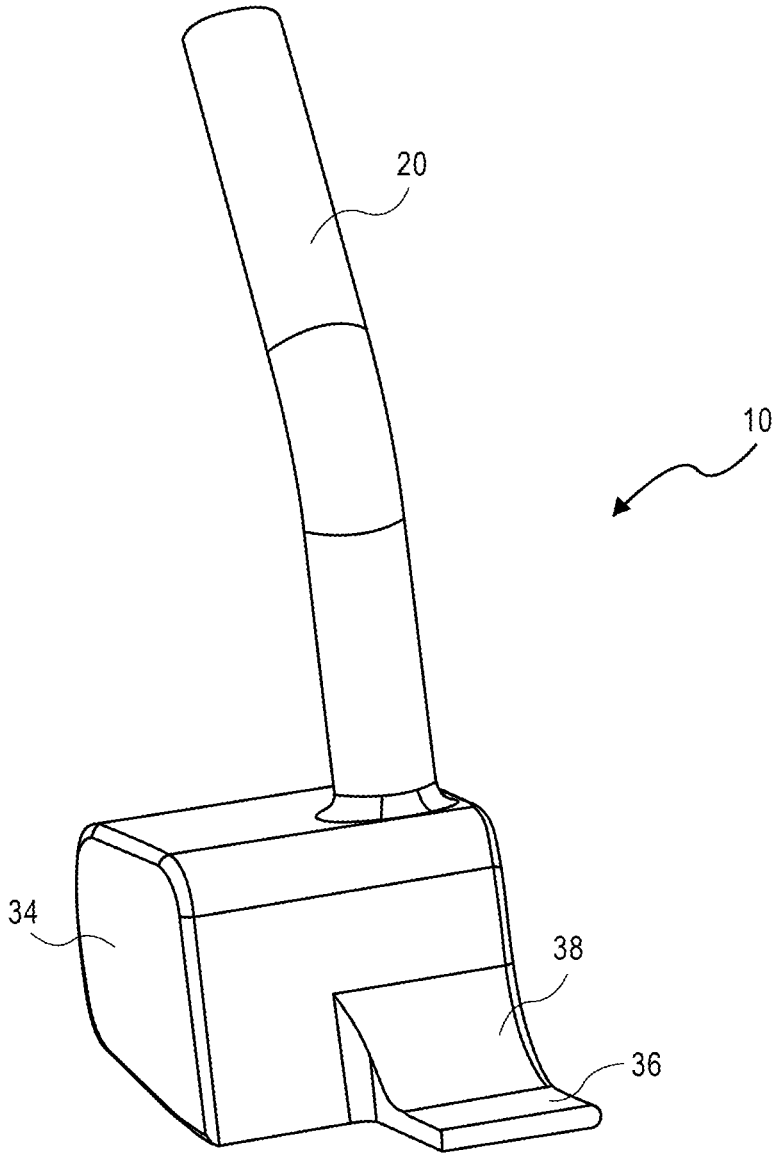

FIG. 1C depicts a cross section of the putter 10. As shown, the connector 36 is attached to the heel section 34 by a coupler 38. The coupler 38 is sloped in the x-direction, such that it starts at some point around the middle of the thickness of the toe section 34 and slopes down to the height at the top of the connector 36. The coupler 38 helps the connector 36 attach securely to the heel section 34 by providing a large contact surface that attaches to the heel section 34. Although not shown, a similar coupler 38 may be used for the other end of the connector 36 to attach to the toe section 32.

Figure 2:
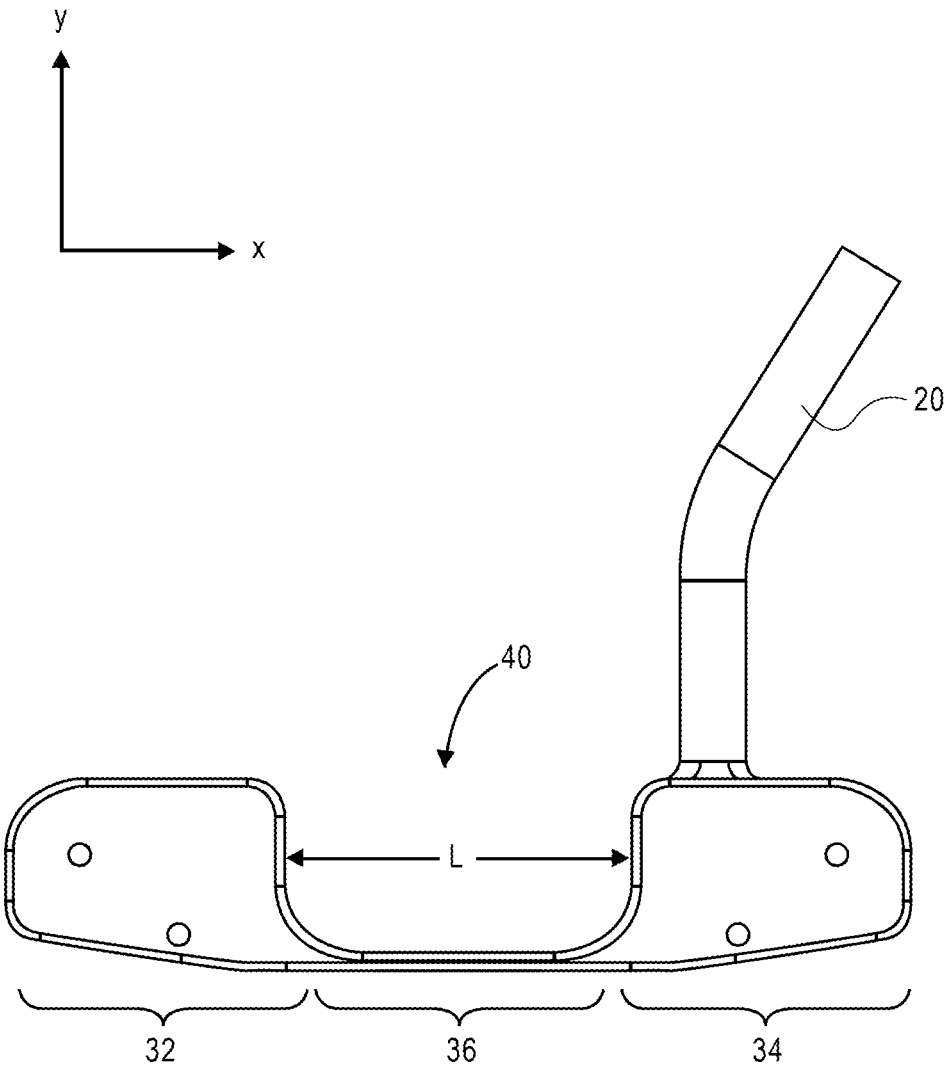
FIG. 2 is a side view of the putter in accordance with one embodiment of the inventive concept.

As depicted in FIG. 2, the opening 40 has a length L in the x-direction, wherein L is wider than the width of a golf ball. For example, given that a typical golf ball is no more than 1.68 inches in diameter, L may be greater than 1.68 inches, for example about 1.8 inches give or take 0.1 inch.

Figure 3:
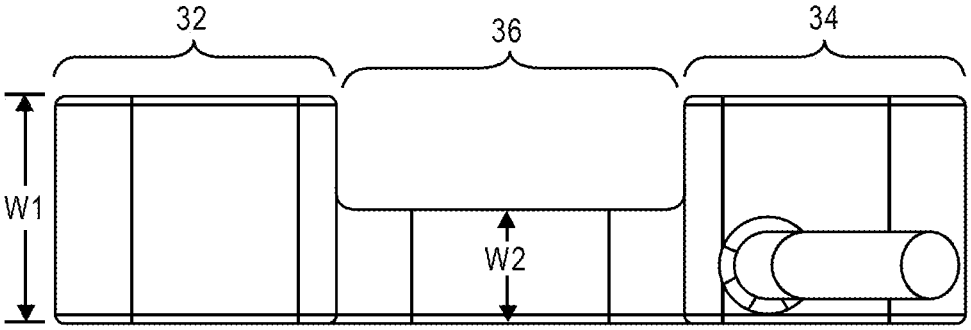
FIG. 3 is a top view of the putter in accordance with one embodiment of the inventive concept.

As shown in FIG. 3, the width w2 of the connector 36 may be about half of the width w1 of the front and heel sections 32, 34. However, this is not a limitation of the inventive concept and w2 may be about equal to w1 in some embodiments. Alternatively, w2 may be any fraction of w1. In some cases, w2 may be less than half of w1.

Figure 4A:
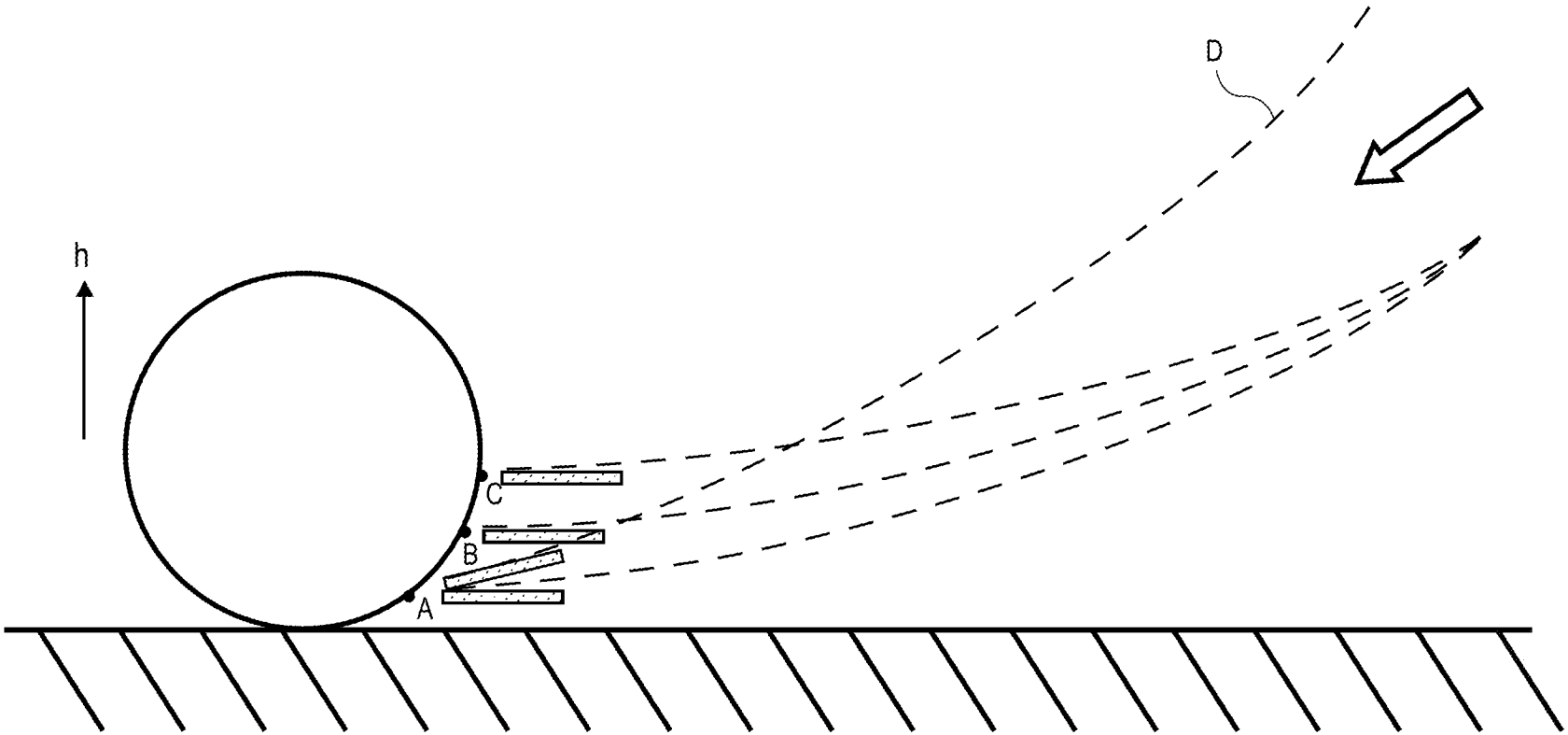
FIG. 4A and FIG. 4B depict example trajectories of a golf ball in reaction to being hit at different points with the putter of the inventive concept.
Figure 4B:
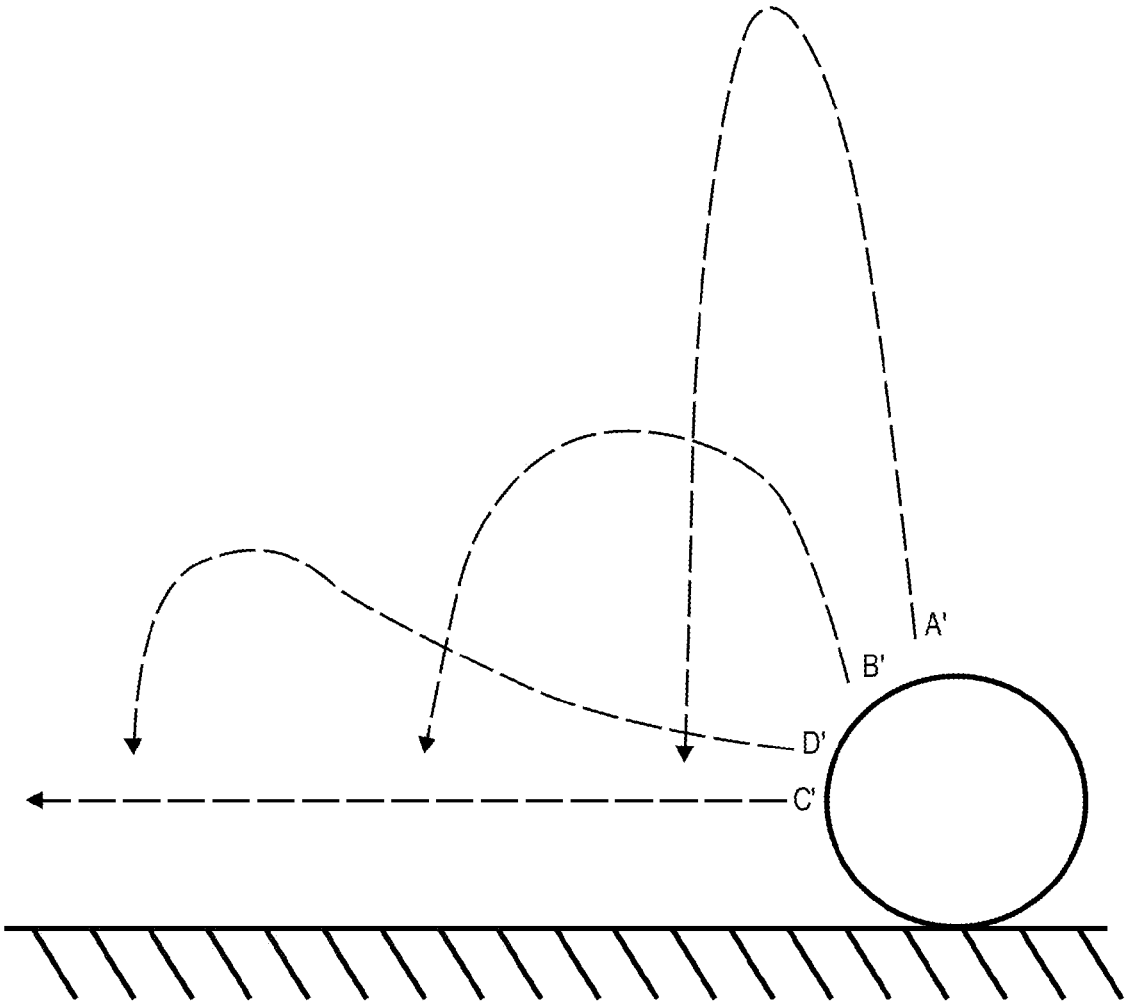

Practicing with the putter 10 in an "open" state where the ball may go through the opening 40 provides instant feedback about the golfer's swing. As mentioned above, the golfer receives instant feedback about 1) whether he hit the ball with the center section of the putter 10, and 2) which part of the ball he hit. Referring to FIG. 4A and FIG. 4B, point C is just around or at the midpoint of the ball. Referring to the direction h in which height is measured (see FIG. 4A), "midpoint" has a height that is about a golf ball radius above the point that touches the ground. With a standard swing, the connector 36 contacts the golf ball near point A, which is a point on the surface of the golf ball close to the ground. Hitting the golf ball at point A results in the ball traveling upward and a short distance forward, as shown by trajectory A' of FIG. 4B. If the connector 36 contacts the ball just below its midpoint, such as at point B, the ball will still travel upward but not as high as if point A were contacted. When point B is hit, the ball will travel farther forward than if point A were hit. Trajectory B' of FIG. 4B shows an example of how the ball would travel if it were hit at point B'. If the connector 36 contacts the ball at a point above its midpoint, such as at point C, the ball will roll or otherwise move forward as shown by trajectory C' of FIG. 4B. Even if the ball is contacted at a point close to point A, if the swing path is steep as shown by swing path D of FIG. 4A, the ball travels differently from trajectory A' due to a spin. In this case, the ball may travel in trajectory D', moving forward into a gradual "jump" or "rise" before dropping to the ground. Using the ball's travel distance and direction as feedback, the golfer can adjust his swing with the goal of consistently getting the ball to travel in trajectory A' or B'.

One of the advantages of practicing with the "open" club head 30 is that as long as the ball is hit correctly, the golfer is spared from having to walk far to retrieve the ball.

FIG. 5, FIG. 6A, FIG. 6B, and FIG. 7 depict the putter 10 with a club face 50 that may be detachably coupled to close the opening 40. After a user practices with the putter 10 in an "open" state, the club face 50 may be attached for real play. As the golfer is used to the feel of the putter 10 from his practices, he will be able to hit the ball using the swing he optimized during practice, but with the club face 50 attached (i.e., in a "closed" state).

Figure 5:
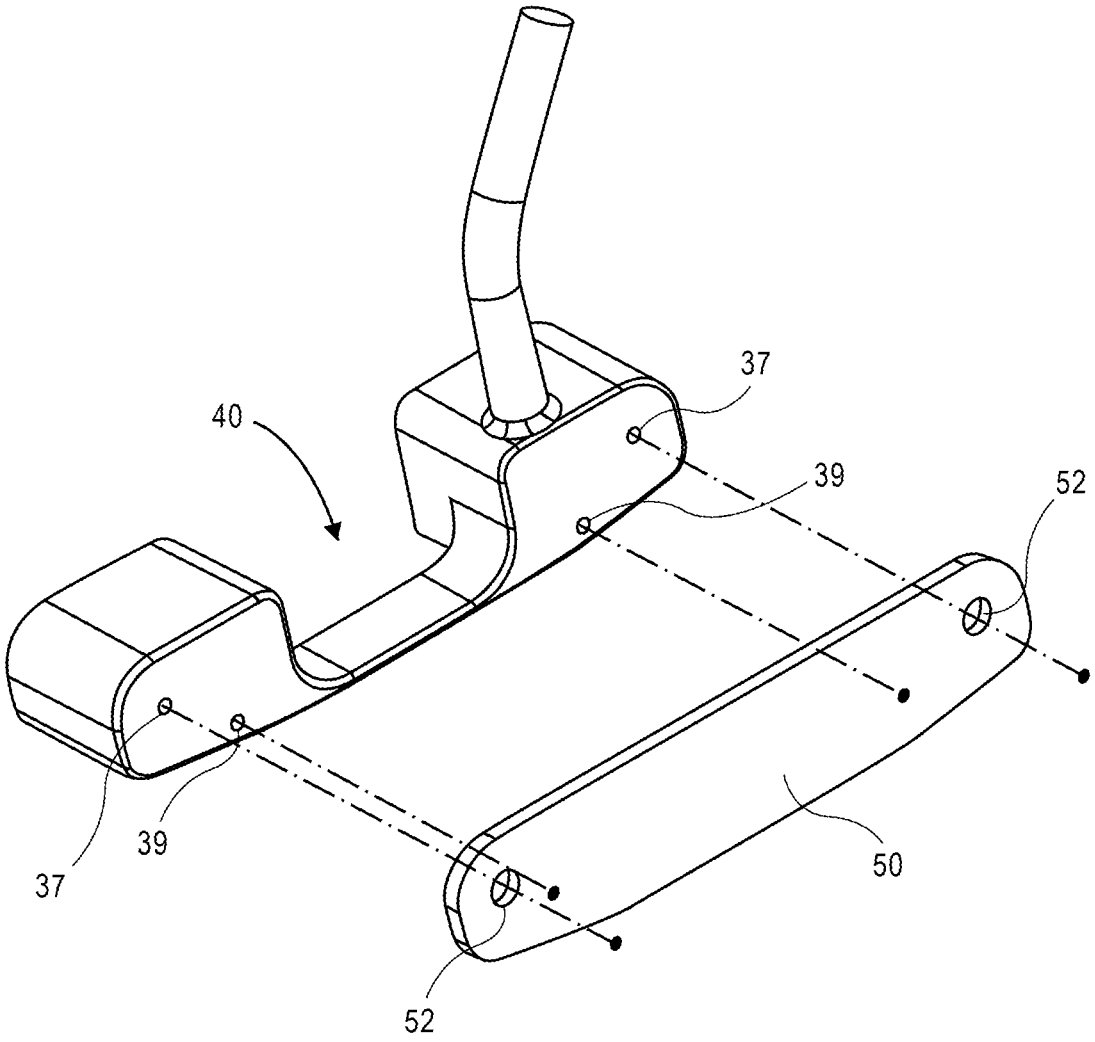
FIG. 5, FIG. 6A, and FIG. 6B are perspective views of a club head and a club face that may be combined in accordance with one embodiment of the inventive concept.

In the particular embodiment that is shown, the club face 50 has a front surface that contacts the golf ball and a back surface that contacts the putter 10. In the particular embodiment, the club face 50 is long enough to extend across the length L of the opening 40, although this is not a limitation of the inventive concept. More specifically, in the embodiment shown, the club face 50 is long enough to extend across the opening 40 and couple to the front surfaces of the toe section 32 and the heel section 34. For example, as shown in FIG. 5, there may be holes 37 formed in the toe section 32 and the heel section 34 that are positioned to align with the holes 52 on the club face 50. A screw or any other fixing rod (not shown) may be inserted through the holes 52 and 37 to keep the club face 50 securely attached to the club head 30. In such a case, the screw or fixing rod should not protrude from the front surface of the club face 50. Alternatively or in addition, the club head 30 may have holes 39 that can receive extending parts 53 on the back surface of the club face 50. The extending parts 53 should fit snugly through the holes 39 so that the club face 50 is fixed securely in place. The holes 39 may be through-holes that allow the extending parts 53 to extend across the width of the club 30 and maybe be visible on the back surface of the toe and heel sections 32, 34. In the particular embodiment, the club face 50 extends across the combined length of the toe section 32, connector 36, and the heel section 34 and makes contact with all three sections. However, this is not a limitation of the inventive concept.

Any other known method may be used to fix the club face 50 to the front surface of the club 30. For example, magnetic strips or surfaces can be used to attach the club face 50 to the club 30.

Figure 6A:
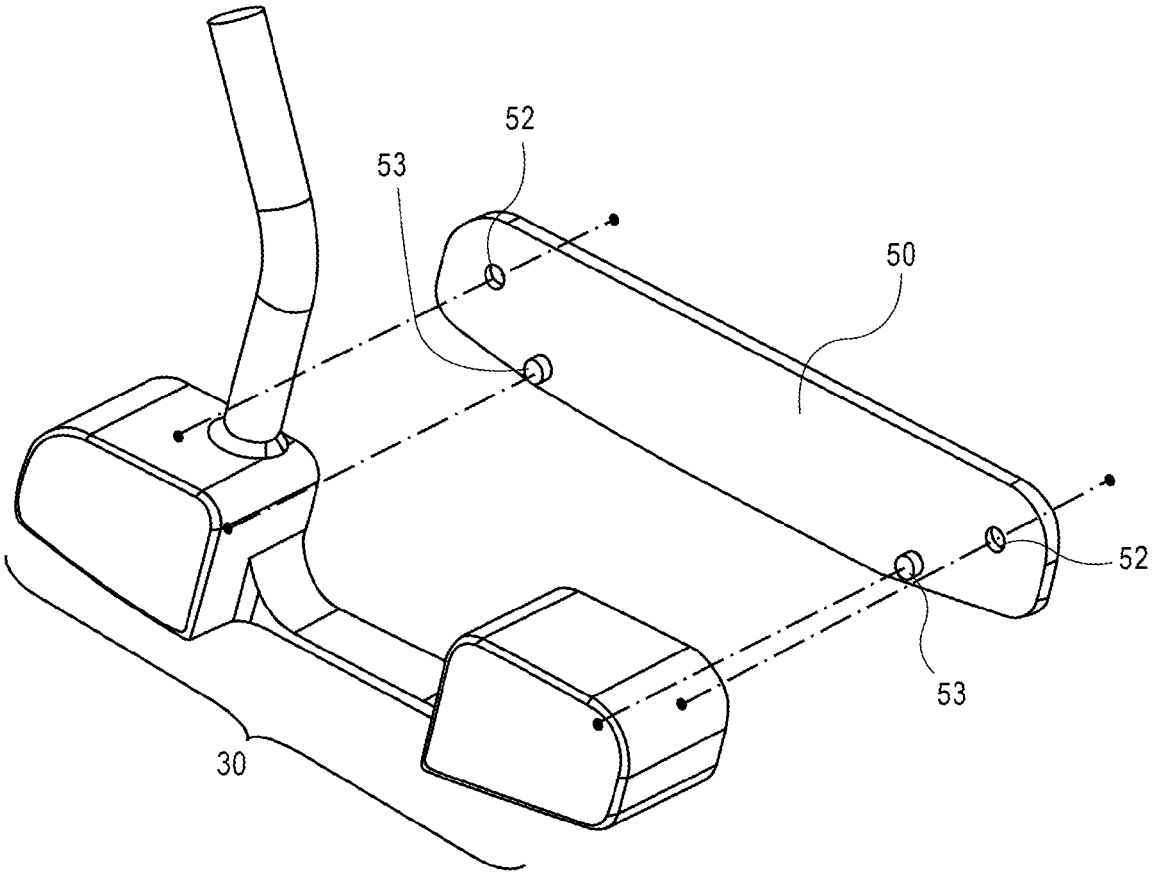
Figure 6B:
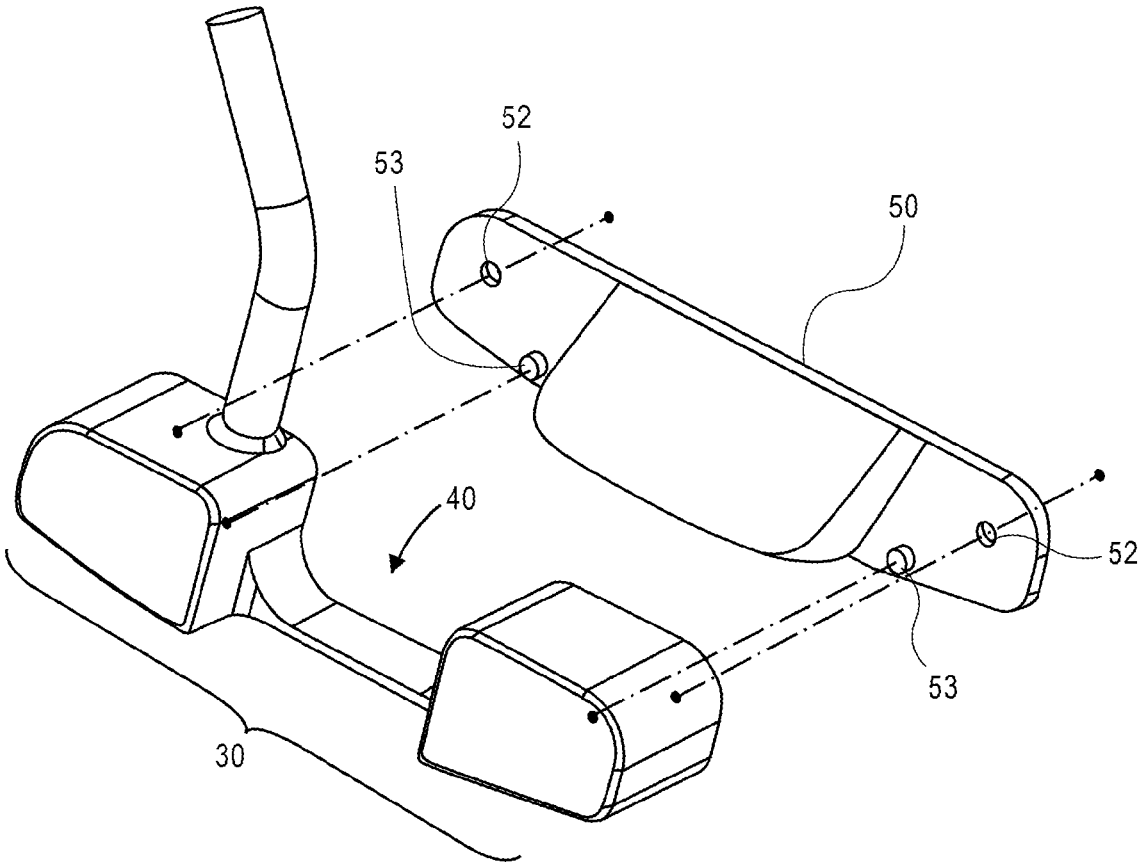

The embodiment of FIG. 6A results in a putter that has a solid front face 50 and a hollow middle area behind the solid front face 50. It should be understood that because there are many different putter shapes and designs available and preferences among golfers vary widely, the club face 50 can be configured such that when combined with the club 30, the desired putter shape is achieved. For example, FIG. 6B shows a club face 50 that has a protruding section on the back surface that is designed to fit into the opening 40. Using the club face 50 of FIG. 6B, the putter 10 can be turned into a putter with a solid club head 30. Other variations are possible.

Figure 7:
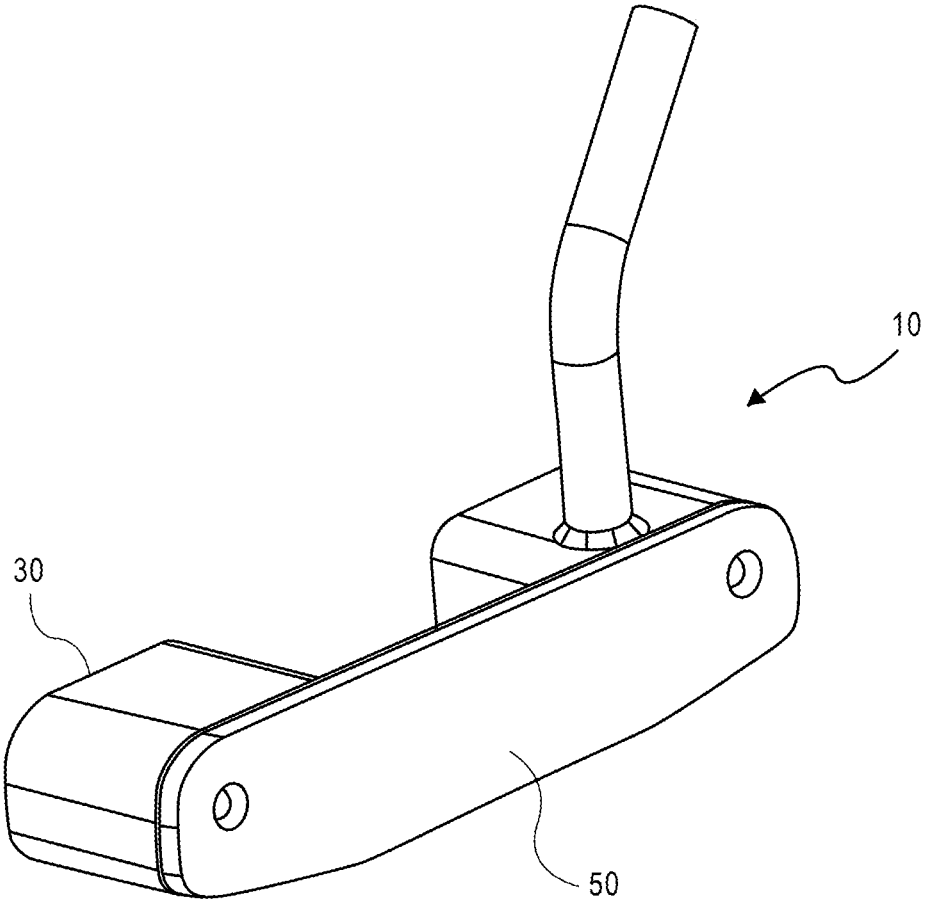
FIG. 7 depicts a putter in a closed state in accordance with an embodiment of the inventive concept.

FIG. 7 depicts a putter 10 resulting from a combination of the club head 30 with the club face 50. This is a putter in a "closed" state.

In the preceding specification, the inventive concept has been described with reference to specific exemplary embodiments. It will, however, be evident that various modifications and changes may be made without departing from the broader spirit and scope of the inventive concept as set forth in the claims that follow. The specification and drawings are accordingly to be regarded as illustrative rather than restrictive. Other embodiments of the inventive concept may be apparent to those skilled in the art from consideration of the specification and practice of the concept disclosed herein.

What is claimed is:

1. A golf putting apparatus comprising a shaft and a club head, wherein the club head has a toe section and a heel section connected only at a bottom by a connector, and wherein the connector has a width that is less than a width of a bottom surface of at least one of the toe section and the heel section.

2. The golf putting apparatus of claim 1, wherein the connector comprises a flat surface.

3. The golf putting apparatus of claim 1, wherein the connector is sloped such that its thickness changes along a width of the club head.

4. The golf putting apparatus of claim 3, wherein the connector is less than 0.1 inches in thickness at its thinnest portion.

5. The golf putting apparatus of claim 1, wherein the connector has a width that is less than or equal to a width of the toe section.

6. The golf putting apparatus of claim 5, wherein the connector has an edge that is flush with front surfaces of the toe section and the heel section.

7. The golf putting apparatus of claim 1, wherein the toe section and the heel section have the same width.

8. The golf putting apparatus of claim 1, wherein the shaft is connected to the heel section.

9. The golf putting apparatus of claim 1, wherein a distance between the toe section and the heel section is at least 1.68 inches.

10. The golf putting apparatus of claim 1, wherein the toe section and the heel section are separated by a distance that allows a golf ball to travel across the club head.

11. The golf putting apparatus of claim 1 further comprising a club face detachably positioned to extend between the toe section and the heel section.

12. The golf putting apparatus of claim 11, wherein the club face attaches to at least one of the toe section and the heel section.

13. The golf putting apparatus of claim 11, wherein the club face comprises a planar surface that extends across the length of the connector.

14. The golf putting apparatus of claim 11 further comprising a hole in the toe section for receiving extending parts on the club face.

15. The golf putting apparatus of claim 11, wherein the club face is magnetically attachable to the toe section.

16. A golf putting apparatus comprising:

a shaft;

a club head connected to the shaft and including a toe section, a heel section, and a connector connecting the toe section to the heel section, wherein the connector has a bottom surface that is flush with bottom surfaces of the toe section and the heel section and a side surface that is flush with front surfaces of the toe section and the heel section, the connector having a width that is less than that of the toe section and the heel section; and a club face that is detachably attached to the club head, wherein the shaft extends from the club head without extending above the connector.

* * * * *